United States Patent [19]

Potter

[11] Patent Number: 5,040,762

[45] Date of Patent: Aug. 20, 1991

[54] ARTIST'S EASEL

[76] Inventor: David J. Potter, 13 High Street, Loddon, Norfolk, United Kingdom, NR14 6ET

[21] Appl. No.: 469,395

[22] Filed: Jan. 24, 1990

[30] Foreign Application Priority Data

Oct. 2, 1989 [GB] United Kingdom ..... 8922153

[51] Int. Cl.[5] ..... A47B 97/04

[52] U.S. Cl. ..... 248/460; 248/129

[58] Field of Search ..... 248/460, 463, 449, 464, 248/331, 465, 129

[56] References Cited

U.S. PATENT DOCUMENTS 3,165,329 1/1965 Libbe ..... 248/351 X

*Primary Examiner*—Alvin C. Chin-Shue

*Attorney, Agent, or Firm*—Neal J. Mosely

[57] ABSTRACT

An artist's easel comprises a framework adapted to receive and hold a canvas, and one or more wheels mounted on the framework and enabling the easel to be wheeled to and from a place of use. The easel also includes means for maintaining the frame in its normally intended attitude of use, and means which, in use, engage the ground on which the easel stands to resist any tendency of the easel to move along the ground. The easel is characterised by two features. Firstly, that the said ground engaging means comprises one or more feet which project at a fixed angle from the lower portion of the frame; and secondly, that the or each wheel is mounted on the fram via a linkage which is so constructed that a user of the easel can move the wheel (or wheels) away from the foot (or feet) to stand the easel on the ground so that the wheels and the or each foot engage the ground in spaced-apart relationship to maintain the frame in its intended attitude of use.

4 Claims, 3 Drawing Sheets

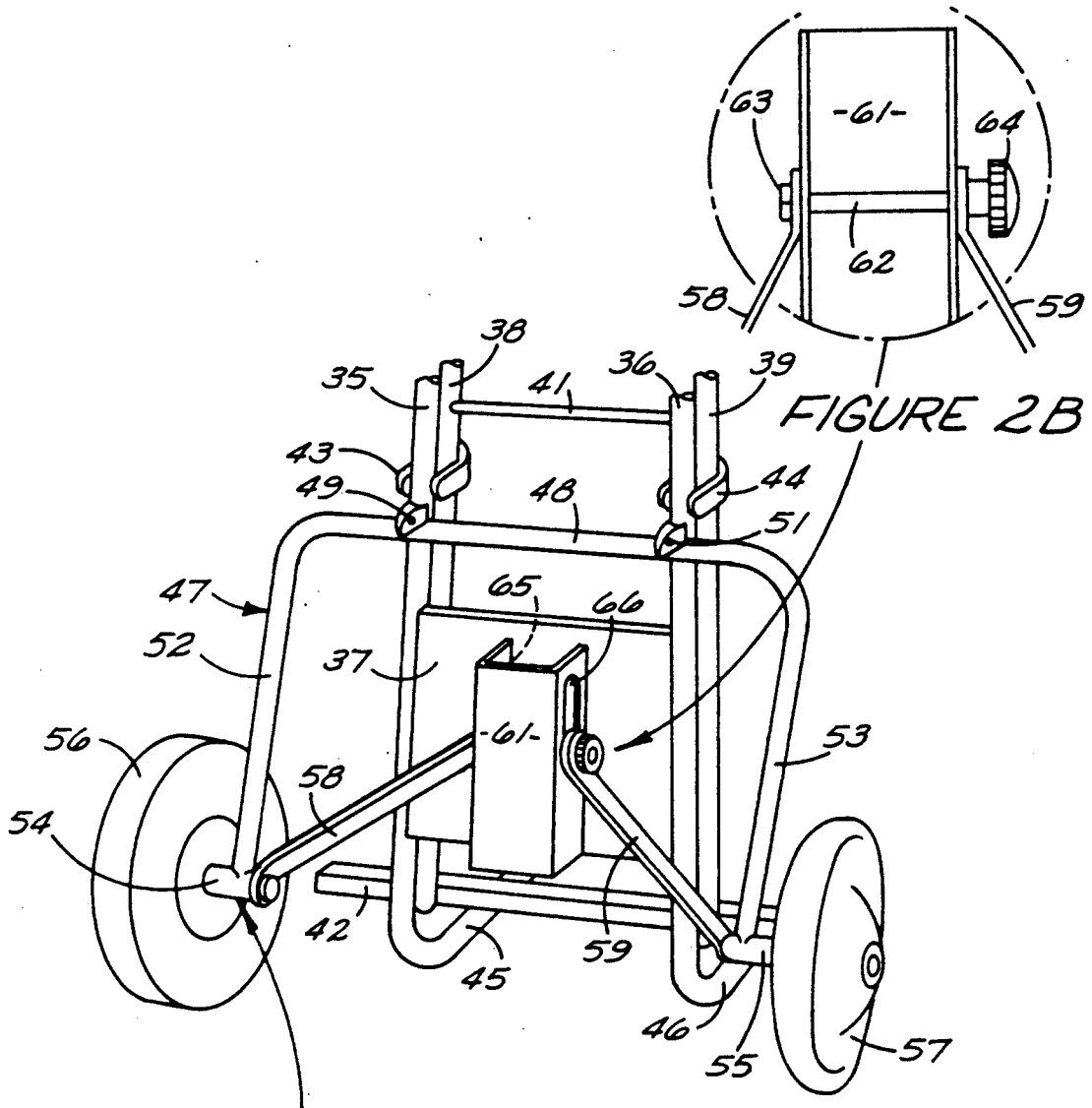
FIGURE 2B
FIGURE 2
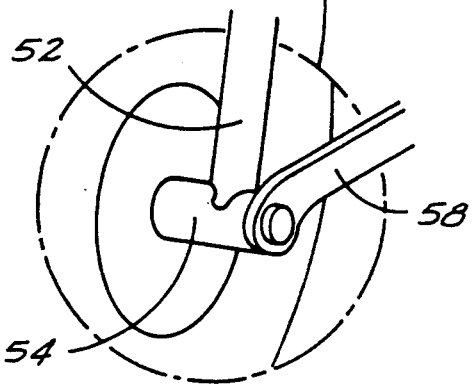
FIGURE 2A

ARTIST'S EASEL

BACKGROUND TO THE INVENTION

The invention relates to artists' easels and is concerned with a novel and inventive improvement to the artists' easel shown in published United Kingdom patent specification number 2 211 083. This published specification, and the prior specifications brought forward against it by the United Kingdom Patent Office in their preliminary examination and search of it, constitute the most relevant art known to the applicant.

SUMMARY OF THE INVENTION

The present invention is defined in the claims of this specification.

BRIEF DESCRIPTION OF THE DRAWINGS

FIGS. 2, 3, 4 and 5 show respectively details of the features in which the preferred embodiment of the present invention differs from that previous one.

DESCRIPTION OF THE PREFERRED EMBODIMENT

Figure 1:
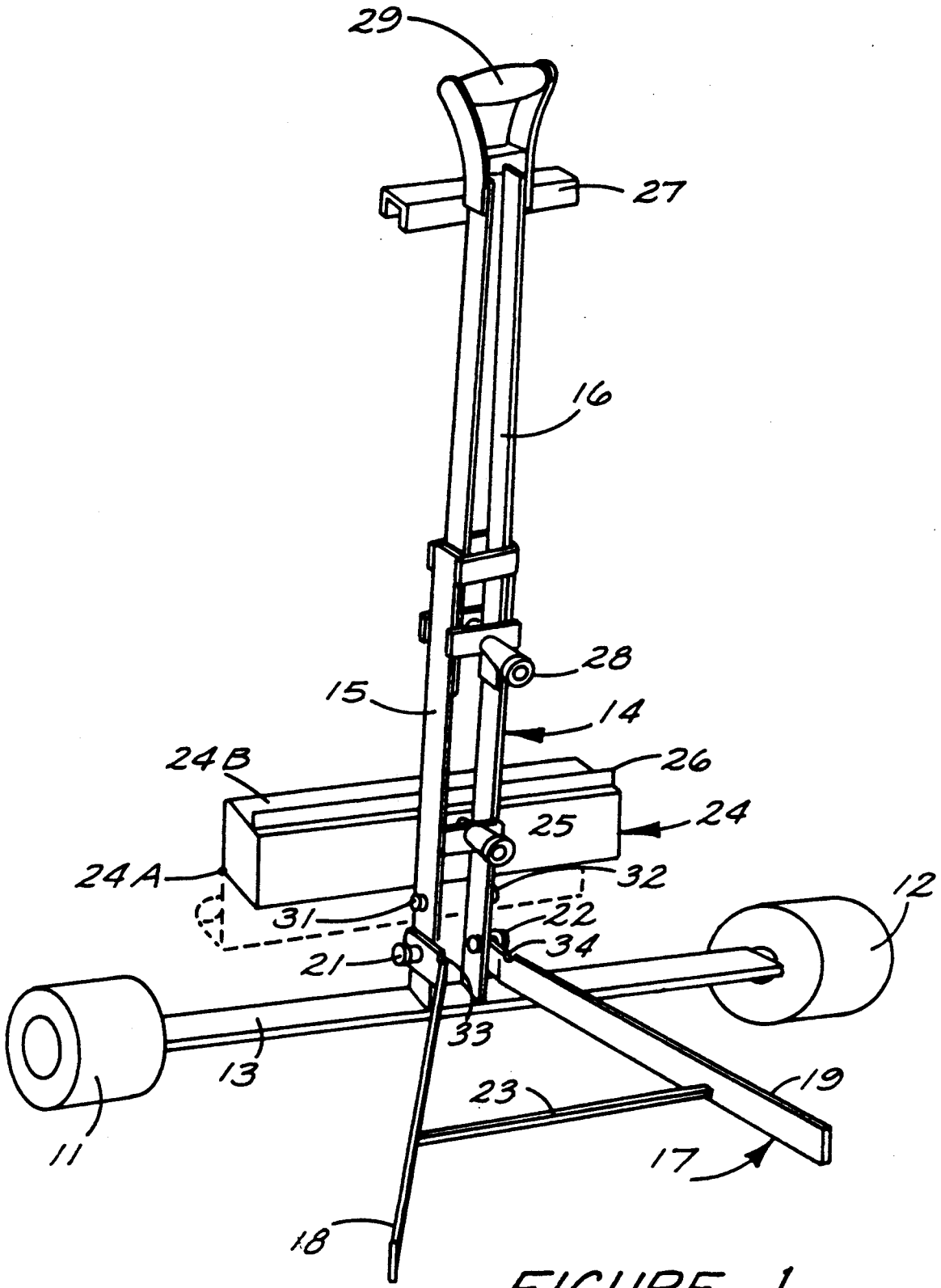
FIG. 1 of the accompanying drawings is identical to FIG. 1 of specification No. 2 211 083; whilst

The best and quickest understanding of the present invention involves initially repeating the description of the preferred embodiment of specification 2 211 083, with reference to FIG. 1. An artist's easel consists essentially of wheels 11, 12 spaced apart by a rigid axle 13 supporting a mast 14. The mast 14 is telescopic with the stem 15 of the telescope fixed to the axle 13 and the barrel 16 of the telescope sliding within the stem 15. The stem 15 forms the base of the mast 14 whilst the barrel 16 forms the extensible and retractable arm of the mast.

Pivoted to the base 15 of the mast 14 is an essentially A-shaped framework 17. The limbs 18, 19 of this framework 17 are splayed outward from the pivot points respectively 21, 22 on the mast base 15. The cross-bar 23 of the A-frame 17 runs generally parallel with the axle 13 spanning the wheels 11, 12.

As shown in the drawing the A-frame 17 can be swung about its pivots 21 and 22 to form with the wheels 11, 12 a four-point ground contact supporting the mast 14 at an angle to the ground on which the easel stands. When the pivots 21 and 22 are tightened by rotating their conventional screw-threaded hand-operated clamping mechanisms as illustrated, the A-frame 17 is held rigidly against the mast 14 and the mast in turn is supported relatively rigidly at its projecting angle from the ground.

A lidded box 24 is fixed to the base of the mast 14 by a screw-threaded hand-operated conventional clamp 25. When the clamp 25 is slackened, the box 24 can be moved up and down the base 15 of the mast 14; and can be fixed in a selected position, within its range of movement, by tightening the clamp 25.

The top surface of the box 25 supports a ledge 26 which runs along the length of the box, at right angles to the run of the mast 14, and which is spaced from the mast base members by an amount sufficient for a board or canvas to occupy the spacing gap and to rest, behind the ledge 26, on the top surface of the box 24.

An angle bar 27 is fixed non-adjustably to the extensible and retractable arm 16 of the mast 14. The screw-threaded hand-operated clamp 28 which, when slackened, allows the arm 16 to be extended and retracted, and when tightened, holds the arm 16 in a selected position within its range of extension and retraction, is used to set the bar 27 at an appropriate height.

An appropriate height, in the context just outlined, is a height at which the board or canvas resting on top of the box 24 behind the ledge 26 can have its top edge located—not necessarily clamped—by the bar 27.

In this embodiment, the bar 27 is lipped along its front edge to assist in locating the board or canvas.

Also in this embodiment, the lid 25 of the box 24 swings open about a hinge 26, running the length of the box, to hang down in a position illustrated in broken line in which it forms effectively a tray for artists' materials. When the lid is closed, and not acting as a tray, the box 24 carries the artist's materials safely.

The lid 25 closes, as will be appreciated, against the front of the ledge 26. The ledge 26 does not move relative to the non-lidded region of the box. The means of fastening the lid 25 shut, and/or of fixing it in its opened downward-hanging position (if this is found necessary), form no inventive feature of the easel and can be left to the intended skilled addressee of this specification to select.

A handle 29 is formed at, and fixed to, the projecting end of the mast arm 16. The handle 29 enables the easel to be pulled along the ground on its wheels 11, 12 when the artist is not working at it; and when the A-frame 17 has been swung into and held in its out-of-use position.

To swing the frame 17, the clamps 21 and 22 are released and the frame pivots into a position in which it occupies substantially the same plane as the mast base 15 and mast arm 16. As illustrated, stops 31 and 32, fixed to the mast base arms, engage cutouts 33, 34 respectively in the limbs 18 and 19 of the A-frame to allow the frame 17 to occupy substantially the same plane as the mast arms.

In that position, and with the clamps 21 and 22 tightened again, the A-frame 17 assists the mast and the ledge-box surface in supporting the board or canvas (not shown). The board or canvas therefore need not be removed from the easel when the easel is wheeled along the ground.

To stop the wheels 11, 12 rotating whilst the easel is in use, a number of means could be employed. Conventional foot-operated braking means such as those used on foldable child's "buggies" (lightweight pushchairs) could be used. Alternatively or additionally, if the wheels were spoked, a strap running through the wheels and round the A-frame 17 and/or the mast 14 could, when tightened, effectively hold the wheels still.

The same strap just referred to could, when first removed to allow the A-frame 17 to swing up into its canvas-supporting out-of-use position, then be strapped around the canvas and run through the frame and/or the mast to hold the canvas securely in position side-to-side whilst the easel and canvas were being wheeled along.

Provision may be made for a sunshade or umbrella to open from the easel and afford protection from the sun or a light shower.

The box may incorporate a palette that folds in such a way that wet paint left on the palette is kept from brushes in the box.

Referring now to FIGS. 2, 3, 4 and 5, these show the details of the wheeled base region of an artist's easel embodying the present invention. The telescopic mast of this newly inventive embodiment can be constructed now by the reader of a result of the foregoing description. The description that follows concentrates therefore on the features of the new embodiment that are different from those of the FIG. 1 embodiment.

Broadly speaking, these differences are twofold.

Firstly, in the FIG. 1 embodiment the A-frame 17 which supports the mast at a convenient working angle in use is movable, about pivots 21 and 22 towards and away from the base region of the mast. In the new embodiment of FIGS. 2 through 5, by contrast, the corresponding section is fixed relative to the main mast.

Secondly, the wheels 11 and 12 and their supporting beam 13 are fixed relative to the main mast in the FIG. 1 embodiment. By contrast, the wheels of the FIGS. 2 through 5 embodiment can swing towards and away from the main mast; and hence towards and away from the mast-supporting feet which are the functional equivalents of the A-frame 17 of the prior embodiment.

These features and the way they have been embodied in FIGS. 2 through 5 will now be described in more detail.

The two opposite side tubes 35, 36 of the bottom region of the main telescopic mast are spaced apart in parallelism by a flat sheet 37 welded between them. The telescoping section of the mast again consists of spaced-apart parallel tubes 38, 39 (the corresponding sections of the FIG. 1 embodiment were rectangular, not tubular, of course) and these latter tubular sections are spaced apart and joined by respective upper and lower bars 41 and 42.

The sliding extending and retracting section 38, 39, etc. is held against the base section 35, 36, 37 by U-clips 43, 44. Each of these clips is welded to a respective one of the tubes 35 and 36. The tubes 38 and 39 slide up and down within the U-clips.

Means of clamping the two telescoping mast sections at selected heights, corresponding to the means 28 of the FIG. 1 embodiment, need not be illustrated but are of course present, higher up the mast. The reader can supply the details on the basis of the totality of the present disclosure.

Figure 3:
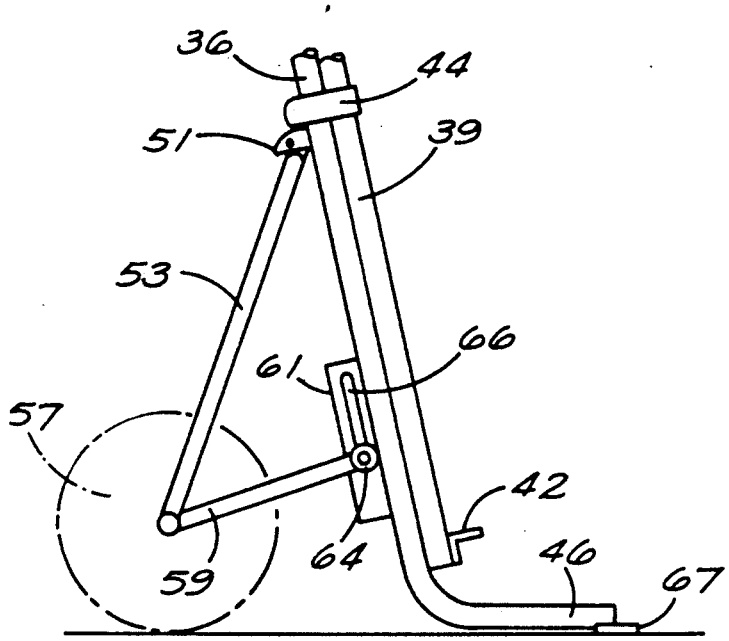

The bottom (i.e. the ground-adjacent) ends of the main mast base tubes 35 and 36 bend round to end in respective feet 45 and 46. Each of these feet is at an angle, slightly greater than a right angle, to its respective main tube length 35 and 36. When the feet 45 and 46 rest on substantially horizontal ground, as illustrated in FIG. 3, the main mast is at a convenient working angle to the artist (not shown) standing in front of it.

A yoke 47 has its cross bar 48 pivoted at 49, 51 respectively on lugs which are welded to each respective one of the tubes 35 and 36 at the back regions of these tubes with respect to the position of the artist eventually using the easel. Each limb 52, 53 of the yoke 47 supports a stub axle 54, 55 respectively with a wheel 56 (57) freely rotatable on each such stub axle. Respective struts 58, 59 are each inherently rigid and are so sized and shaped as to run from their adjacent stub axles to a U-shaped box 61 welded to the back of the sheet 37 spanning and spacing apart the main mast base tubes 35 and 36.

The struts 58 and 59 are spanned and joined by a headed bolt 62. At the threaded extremity of this bolt opposite its head 63 is a knurled hand wheel 64. The bolt 62 passes through aligned slots 65, 66 in the opposite limbs of the U-plate 61, as well as passing through the ends of the struts 58 and 59, and thereby effectively pins the strut-ends to move up and down in the aligned slots 65 and 66.

This up and down movement, however, just referred to is only possible when hand wheel 64 is sufficiently slackened. When the hand wheel is tightened, struts 58 and 59 are locked in position on the U-plate 61.

Because struts 58 and 59, and yoke limbs 52 and 53, are all inherently rigid they form in effect a linkage which is so constructed that a user of the easel can move wheels 56 and 57 towards and away from main frame 35 and 36; and hence towards and away from main frame supporting feet 45 and 46.

In one extreme position, illustrated in FIG. 2 and again in FIG. 3, wheels 56 and 57 are moved away from feet 45 and 46 to their maximum extent permitted by the structure of linkage 52, 53, 58, 59. Hand wheel 64 is screwed home to clamp bolt 62, and hence struts 58 and 59, at the bottom end of the aligned slots 65 and 66. Wheels 56 and 57 are then held rigidly in relation to feet 45 and 46 and the wheels, and the feet, between them constitute ground-engaging means resisting any tendency of the easel to move along the ground; because whilst wheels 56 and 57 are freely rotatable, feet 45 and 46 will tend to drag (and their undersides may indeed be ribbed or otherwise treated to frictionally resist movement and maximise any such dragging tendency).

To further enhance this utility of the described embodiment, a bar 67 spans the extremities of feet 45 and 46 and rests, in use, on the ground. The artist need only plant one of his feet on that bar, which has been especially conveniently positioned for the purpose at a comfortable working distance in front of the easel, to stop any practical tendency of the easel to move away from him as he applies paint to canvas.

Figure 4:
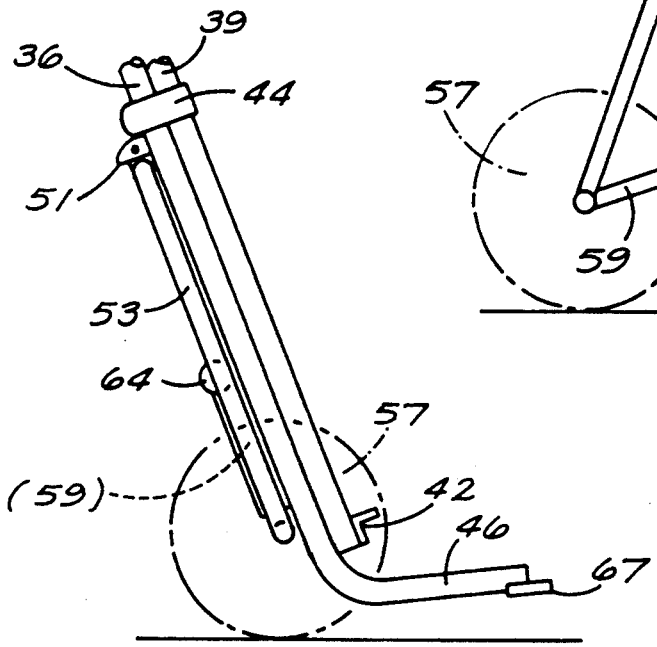

In the other extreme position, illustrated in FIG. 4, when the easel is no longer required for use—and after unclamping hand wheel 64 to free struts 58 and 59 to slide up and down in slots 65 and 66—wheels 56 and 57 can be folded towards feet 45 and 46 until struts 58 and 59 contact the back of frame tubes 35 and 36 respectively. In that position, hand wheel 64 can be clamped down tight again, to hold the entire linkage rigidly in place; and the yoke 47 and its wheels 56, 57 effectively form a "fold-flat" package with the structure 35, 36, 37 and 61. In this state, and with the mast telescoped to its shortest overall extent, the easel can conveniently be transported whilst occupying the least possible room in a motor vehicle or in the luggage compartment of a train.

Figure 5:
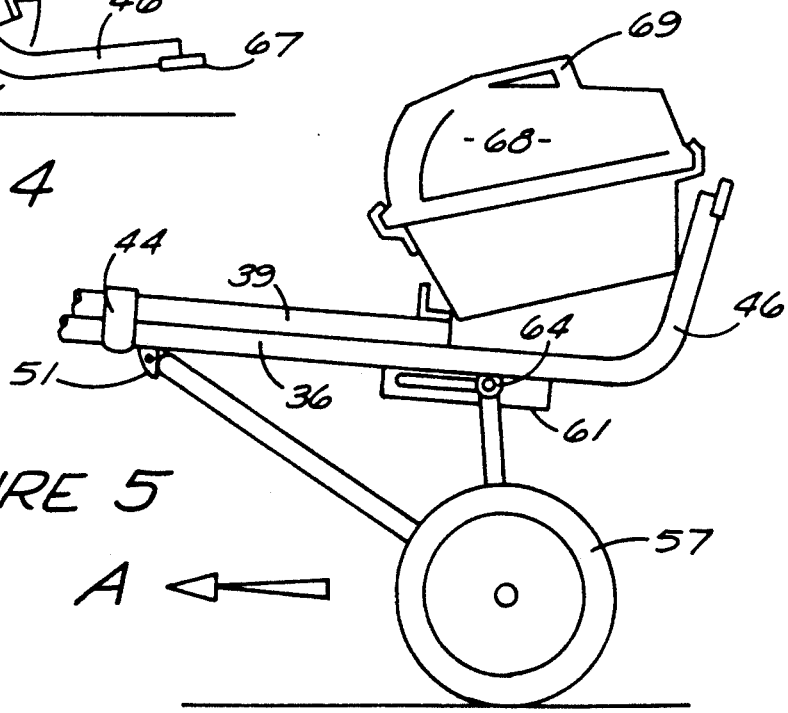

Finally FIG. 5, showing the easel being wheeled along in the direction of arrow A, illustrates how a lidded box 68 can be carried along with its base resting between bar 42 and the crook defined by frame tubes 35 and 36 and feet 45 and 46. Bar 42 is the bar that normally supports the bottom rail of the canvas frame when the easel is in use. Box 68 may exhibit a carrying handle 69 rising from the central region of its lid, which is hinged to its base, and—unlike box 24 of the FIG. 1 embodiment—box 68 is not designed to be part of the easel. But it is so proportioned that it fits, as FIG. 5 shows, conveniently and securely for transport when the easel is being wheeled along.

I claim:

1. An artist's easel comprising a framework comprising a horizontally oriented base member and a first pair of vertically extending tubular members secured in laterally spaced relation on said base member and having their lower ends bent outward to provide feet operable to engage the ground in parallel relation thereto, a second pair of tubular vertically extending members with cross braces securing said members in alignment one with each of said first pair of members, means on one of said vertically extending members securing said first and said second pair of members together for vertical telescopic movement, an upper clamping member fixed on said first vertically-extending members including means for securing a canvas to said framework, a lower clamping member supported for vertical movement with said second vertically-extending members including means to secure a canvas on said framework during movement, a yoke pivotally mounted on said first pair of vertically extending members and wheels supported at the lower ends thereof, said yoke being moveable between a first position with said wheels spaced from said ground-engaging feet to support said easel in the attitude of use and a second position against said first pair of vertically extending members with said wheels projecting below said ground-engaging feet to allow the easel to be wheeled two and from a place of use.

2. An easel according to claim 1 including a linkage supported on said horizontally oriented base member of said first pair of vertically extending members and connected to said yoke to secure said wheels in said first and said second positions.

3. An easel according to claim 2 in which said linkage includes means to secure said wheels in one of said positions.

4. An easel according to claim 2 in which said upper vertically-extending member has a handle member secured on its upper end.

* * * * *